United States Patent [19]

Jones

[11] 4,142,762

[45] Mar. 6, 1979

[54] ROCKABLE AGAINST-THE-WALL TYPE RECLINING CHAIR

[76] Inventor: W. Dale Jones, 7020 Aztec Dr. NE., Albuquerque, N. Mex. 87110

[21] Appl. No.: 850,477

[22] Filed: Nov. 11, 1977

Related U.S. Application Data

[63] Continuation-in-part of Ser. No. 840,667 and Ser. No. 840,668, both Oct. 11, 1977, which both is a Continuation-in-part of Ser. No. 720,244, Sep. 3, 1976, Pat. No. 4,057,289.

[51] Int. Cl.[2] ..... A47C 1/02

[52] U.S. Cl. ..... 297/84; 297/259; 297/344

[58] Field of Search ..... 297/84, 85, 259, 311, 297/329, 332, 344

[56] References Cited

U.S. PATENT DOCUMENTS

| | | | |
|---|---|---|---|
| 1,237,956 | 8/1917 | Pue | 297/344 X |
| 1,724,535 | 8/1929 | Van Auken | 297/344 X |
| 2,268,914 | 1/1942 | Vandervoort | 297/332 |
| 2,864,430 | 12/1958 | Ulrich | 297/344 X |
| 3,232,574 | 1/1966 | Ferro | 297/329 X |
| 3,295,885 | 1/1967 | Barksdale | 297/84 |
| 4,072,342 | 2/1978 | Johnson et al. | 297/84 |

*Primary Examiner*—James C. Mitchell
*Attorney, Agent, or Firm*—Learman & McCulloch

[57] ABSTRACT

A rockable against-the-wall type reclining chair includes a chair frame rockably mounted upon a carriage which is rollably supported on tracks mounted in a forwardly downward incline upon a stationary base. The chair seat, back, and foot rest are in turn supported on the chair frame by a reclining linkage. The carriage is normally retained at a rearward against-the-wall position upon the base by releasable latch means coupled between the base and a linkage supported element of the assembly to be released in response to a slight reclining movement initiated by the occupant of the chair. When the latch is released, the chair carriage rolls gravitationally away from the wall to a position where rocking and reclining can occur. A chair frame return spring system is operable to apply a relatively light biasing action against the advancing movement of the carriage toward the away-from-the-wall position. A one-way drive mechanism is cocked by the reclining action of one portion of the reclining linkage and upon subsequent return of that element to its normal position, the drive mechanism substantially increases the tension of the return spring system so that the carriage is firmly restored to its against-the-wall position as soon as the chair becomes unoccupied. Upon restoration of the carriage to its against-the-wall position, the increased tension is released from the spring system.

9 Claims, 7 Drawing Figures

ROCKABLE AGAINST-THE-WALL TYPE RECLINING CHAIR

REFERENCE TO RELATED APPLICATIONS

This application is a continuation-in-part of my two co-pending applications Ser. Nos. 840,667 and 840,668, both filed on Oct. 11, 1977. Applications Ser. Nos. 840,667 and 840,668 are in turn continuations-in-part of my earlier filed application Ser. No. 720,244, filed Sept. 3, 1976, now U.S. Pat. No. 4,057,289.

BACKGROUND OF THE INVENTION

In my co-pending applications Ser. Nos. 840,667 and 840,668 there are disclosed several forms of rockable against-the-wall type reclining chairs which include a carriage mounted upon a stationary base by a roller-track arrangement which enables the carriage to advance forwardly away from a wall to a position such that rocking or reclining of the chair can take place with adequate clearance from a wall surface located closely adjacent the rearward side of the base. Generally speaking, all of these arrangements rely upon a forward and downward tilting of the roller track so that the carriage is gravitationally biased to its forward away-from-the-wall position. This gravitational bias is derived from the weight of the chair elements supported upon the carriage, plus the weight of the chair occupant. Various return spring arrangements are disclosed in the two aforementioned co-pending applications. The spring systems are designed so that bias exerted by the spring is insufficient to overcome the gravitational bias exerted by the weight of the chair elements plus the weight of the occupant so that the carriage will remain at its forward end limit of movement as long as the chair is occupied. When the weight of the occupant is removed from the chair, however, the return spring system is capable of overcoming the gravitational bias exerted by the weight of the chair elements alone and is thus operable to return the carriage to its rearward against-the-wall position.

Because the prior systems rely upon the weight of the occupant of the chair and the spring system normally is not regulated with a high degree of precision, problems sometimes arise when the chair occupant is of relatively light weight. If the chair occupant is, for example, a small child, some difficulty may be encountered in moving the carriage to its forward away-from-the wall position against the action of a relatively heavily biased return spring. If, on the other hand, the biasing action of the return spring is relatively low, problems in returning the carriage to its rearward against-the-wall position may be encountered.

The present invention is especially directed to a return spring system which is designed to exert a relatively light biasing action against forward advancement of the carriage to its away-from-the-wall position and to transmit movement of a portion of the reclining linkage back to its normal position to the return spring system to substantially increase the tension of the system to assure adequate strength for return of the carriage to its rearward end limit of movement.

SUMMARY OF THE INVENTION

An against-the-wall type rockable reclining chair embodying the present invention includes a stationary base upon which roller receiving tracks are mounted with a permanent downward and forward inclination.

A carriage is supported from these tracks by rollers mounted on the carriage so that the carriage is normally gravitationally biased toward its forward away-from-the-wall position. A chair frame is rockably supported on the carriage and a reclining linkage in turn supports the chair seat, back, and foot rest upon the chair frame. The reclining linkage is of a type in which the rear portion of the chair seat is moved upwardly and forwardly relative to the chair frame during the initial reclining movement of the system. The chair seat carries a latch striker member which is engageable with a latch member mounted upon the chair base to releasably latch the chair carriage in its rearward against-the-wall position when the chair is in its upright position.

In the embodiment specifically disclosed in the drawings, an independently actuated foot rest linkage is provided in which the foot rest may be extended or retracted by the chair occupant by manipulating a lever carried on the chair frame. A return spring arrangement includes a return spring system coupled at one end to the chair base and at its other end to the carriage via the shaft which is manipulated by the foot rest controlling lever. A one-way rotatable drive mechanism is cocked by rotation of the lever to the foot rest extended position. When the foot rest lever is subsequently shifted to the foot rest retract position, the one-way drive mechanism extends the return spring by a predetermined amount, thereby substantially increasing the tensioning action of the spring system. When the chair carriage returns to the rearward against-the-wall position, the one-way drive mechanism is manipulated to release the extra tension previously stored in the spring system so that subsequent movement of the carriage away from the against-the-wall position is opposed only by a relatively light biasing action.

Other objects and features of the invention will become apparent by reference to the following specification and to the drawings.

IN THE DRAWINGS

Figure 2:
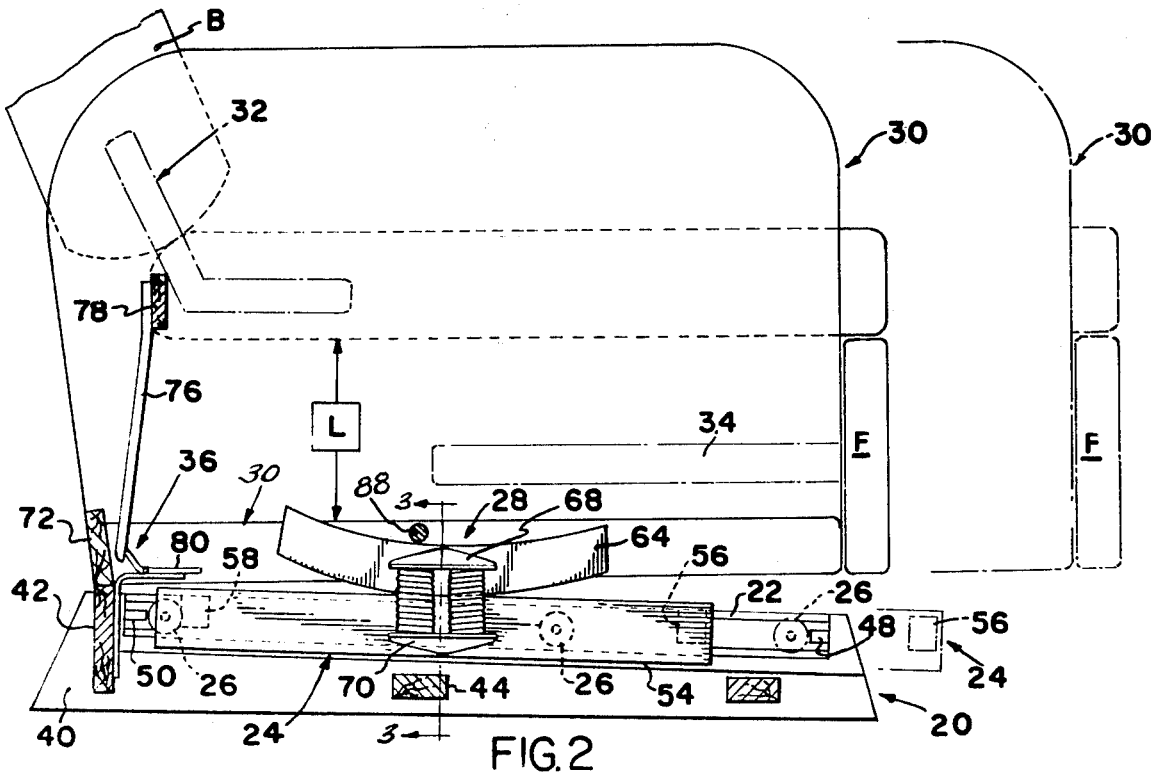
FIG. 2 is a cross sectional view of the chair in FIG. 1 taken on the line 2—2 of FIG. 1.

A rockable reclining chair embodying the present invention is constructed of several basic sub-assemblies which include: a base designated generally 20, to which is mounted roller tracks 22; a carriage designated generally 24 which is supported for forward and rearward movement upon roller tracks 22 as by rollers 26; rocking spring mechanisms designated generally 28; a chair frame designated generally 30 supported by rocker spring mechanisms 28 for rocking movement upon carriage 24; reclining linkage schematically indicated generally at L; a chair seat S and a chair back B assembled by reclining linkage L to chair frame 30 for coordinated movement between a normal upright position shown in FIG. 2, and a reclined position; foot rest control linkage schematically indicated generally at 34 and FL; a foot rest F assembled by foot rest control linkage FL to chair frame 30 for movement between a normal retracted position (FIG. 2) and an extended position; an arrangement for latching chair frame 30 to base 20 designated generally 36; and a carriage return spring system designated generally 38.

Figure 1:
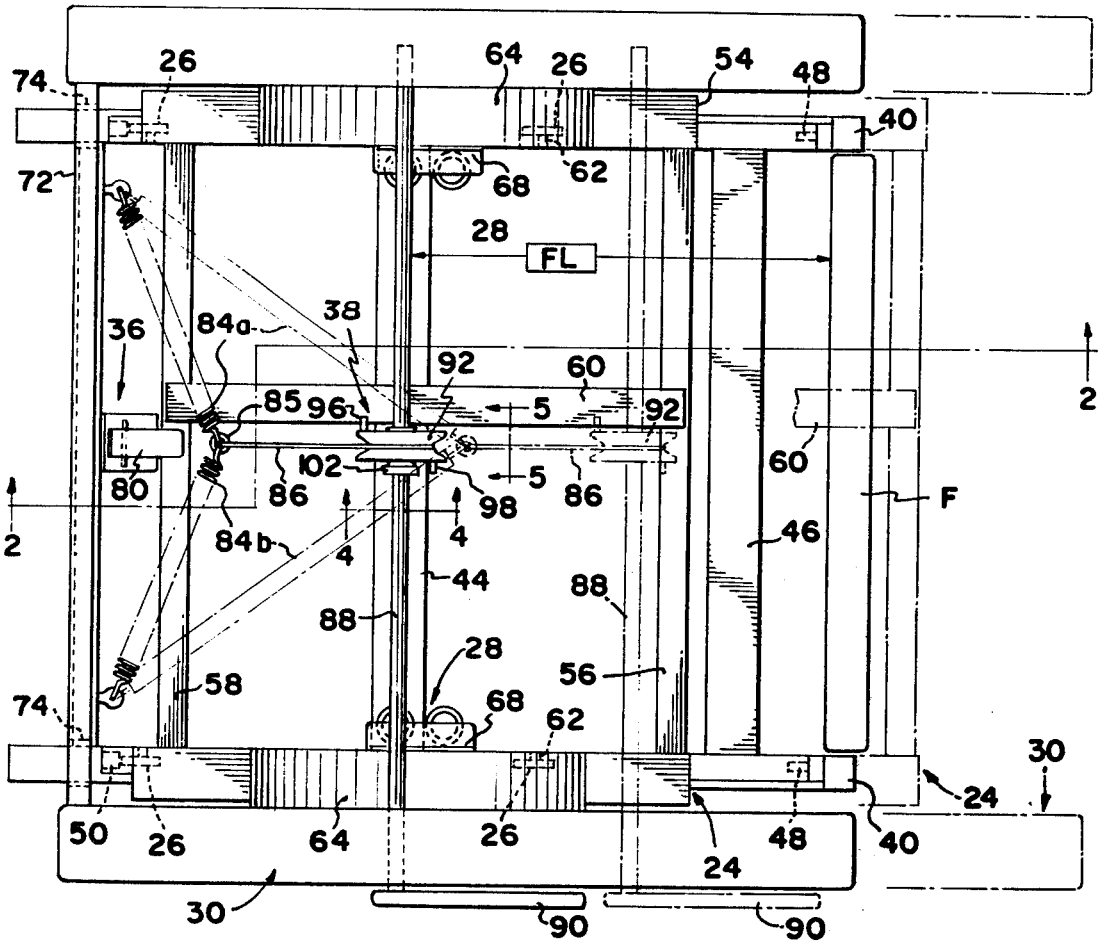
FIG. 1 is a top plan view of a chair embodying the invention with certain parts omitted or broken away.
Figure 3:
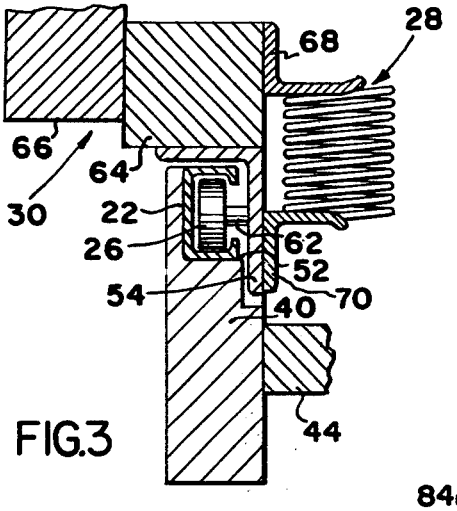
FIG. 3 is a detailed cross sectional view taken on the line 3—3 of FIG. 2.
Figure 7:
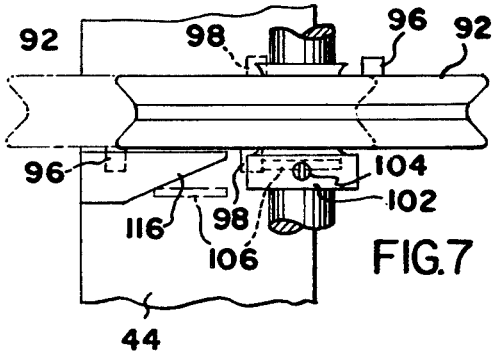
FIG. 7 is a partial top plan view of the structure shown in FIG. 6.

Referring now to FIGS. 1 and 2, base 20 comprises parallel side frame members 40 rigidly interconnected to each other by a transversely extending rear cross frame member 42, intermediate cross frame member 44 and front cross frame member 46. Roller tracks 22 are fixedly mounted in a forward and downward incline on base side frame members 40 and incorporate front and rear roller stops 48, 50. As best seen in FIG. 3, tracks 22 are of C-shaped cross section and are secured within recesses 52 of members 40. Rollers 26 are retained within tracks 22, as shown in FIG. 3, and are mounted to side frame members 54 of carriage 24. As best seen in FIG. 1, carriage 24 includes transversely extending front and rear cross frame members 56, 58, which rigidly interconnect side frame members 54, and a central frame member 60.

As best seen in FIG. 3, the vertical webs of side frame members 54 of carriage 24 serve to mount rollers 26 to carriage 24 by means of axles 62, while the upper surfaces of the horizontal webs of members 54 serve as rocking supports or platforms for rockers 64 which are fixedly mounted to side frame members 66 of chair frame 30. Rocking spring mechanisms 28, which are of conventional construction, include upper and lower spring brackets 68, 70 which are fixedly assembled respectively to rockers 64 on chair frame 30 and the vertical webs of carriage side frame members 54.

As shown in FIG. 2, chair frame 30 is prevented from rocking backwardly when carriage 24 is at its rearward or against-the-wall position by the abutment of its rear cross frame member 72 and rear cross frame member 42 of base 20. Also, as indicated, chair frame rear cross frame member 72 incorporates cut out spaces or slots 74 (FIG. 1) which receive base side frame members 40, without interference, as the chair is rocked rearwardly when at the reclining and rocking position.

In FIG. 2 it can be observed that chair frame 30 is normally retained at the against-the-wall position by latching arrangement 36, which includes a latch arm 76 fixedly mounted to and projecting downwardly from rear cross frame member 78 of the chair seat S.

The chair seat S and back B are supported upon chair frame 28 by a reclining linkage L which may take the form of any of several commercially available against-the-wall type reclining linkages. Such linkages normally impart an upward and forward movement to the rear of the chair seat at least in the initial portion of the reclining movement—see for example U.S. Pat. No. 3,235,307. This upward and forward movement is employed to release latch arm 76 from a latch member 80 fixedly mounted on rear cross frame member 42 of base 20.

Because of the downward and forward inclination of roller tracks 22, when the latch assembly 76, 80 is disengaged, carriage 24 is free to roll forwardly along tracks 22 from the full line position shown in FIG. 2 to the broken line position indicated at the right hand side of FIG. 2. Because the chair frame 28, seat, back, and footrest are all supported upon carriage 24, these elements move with the carriage, and the forward movement of these latter elements carries them sufficiently away from a wall located to the rear of the base so that rocking and reclining movement of the chair can take place without interference from the adjacent wall surface. To restore the carriage to its normal against-the-wall position, a return spring system is provided.

Referring first to FIG. 1, the return spring system includes a pair of springs **84*a* and 84*b*, each of which are coupled at one end to the rear cross frame member 42 of the chair base. The opposite ends of springs 84*a* and 84*b* are commonly connected to each other as at 85 and this point of connection is in turn connected by a flexible line or cord 86 which is in turn connected to mechanism 38** in a manner to be described in further detail below.

The arrangement of springs **84*a* and 84*b* is such that they apply a relatively light tension urging carriage 24 rearwardly when the carriage is at its rearward end limit of movement. This configuration of springs 84*a* and 84*b* is shown in full line in FIG. 1 where it will be noted that the line of action of the springs is at a substantial angle to the front to rear axis of the chair and thus only a very small component of the spring force is exerted in the rearward direction. As the carriage moves forwardly, the springs 84*a* and 84*b*** are not only extended to increase their tensile force, but the line of action of the springs further moves toward parallelism with the front to rear axis of the chair, thus exerting a greater component of a greater force as a rearward biasing action.

The primary function of the return spring system is to automatically return the carriage, and hence the chair elements, to its rearward against-the-wall position upon the base when the occupant arises from the chair. In order to accomplish this function, the biasing action of the return spring must be great enough to pull carriage 24 and the chair elements supported upon the carriage rearwardly up the incline established by tracks 24. In order to accomplish this the biasing action exerted by the return spring system must exceed the gravitational bias exerted on the incline by the weight of carriage 24 and the chair elements supported upon the carriage.

However, the biasing action of the return spring system should not exceed the gravitational bias exerted by the weight of the carriage and carriage supported chair elements by too great an amount because otherwise the biasing action of the return spring system would exceed the gravitational bias represented by the weight of the chair elements augmented by the weight of the occupant of the chair. Thus, desirably the return spring system should exert a relatively low bias opposing forward movement of the carriage so that the carriage can roll easily to its forward end limit of movement. During forward movement of the carriage toward its away-from-the wall position, a light rearward biasing action is desirable to minimize the acceleration of the carriage as it rolls downhill toward its forward end limit of movement on tracks 22. Likewise, when the occupied chair is at its forward end limit of movement, it is desired to retain the carriage there and hence again in this situation only the relatively light rearward bias is desirable so that variations of this bias caused by rocking or shifting of the weight of the occupant are not overcome by the spring.

However, when the occupant arises from the chair a relatively firm rearward bias is desired so that the carriage and supported chair elements are firmly returned to their rearward end limit of movement.

Mechanism 38 is designed to provide a means for increasing the spring bias as the occupant prepares to arise from the chair.

In the specific embodiment disclosed, the chair is shown with a foot rest F which is manually operated by the chair occupant independently of the operation of the chair seat and back supporting linkage L. It will become apparent, however, from the following description that a manually actuated foot rest is but one means for increasing the spring bias and that reclining and antireclining motion of other chair elements or of elements in a reclining linkage could be employed to provide the desired increased bias of the spring system.

Manually actuated foot rest linkages are well known in the art and thus portions of such a linkage have been illustrated only schematically at FL (FIG. 1). Typically, such linkages are actuated by rotation of a shaft having a manually movable operating arm which enables the chair occupant to rotate the shaft. Rotation of the shaft is in turn applied to a linkage which will retract or extend the foot rest in response to rotation of the shaft. One example of such an arrangement is shown in U.S. Pat. No. 3,099,487. For purposes of clarity only the foot rest linkage actuating shaft 88 and its operating arm 90 have been shown in the drawings.

As best seen in FIG. 1, the foot rest operating shaft 88 is rotatably supported in the chair frame 30 and extends transversely across the chair from side to side. Because the shaft 88 is supported in the chair frame, it moves forwardly and rearwardly relative to base 20 in accordance with movement of carriage 24. Operating arm 90 is fixedly mounted on one end of shaft 88.

Figure 4:
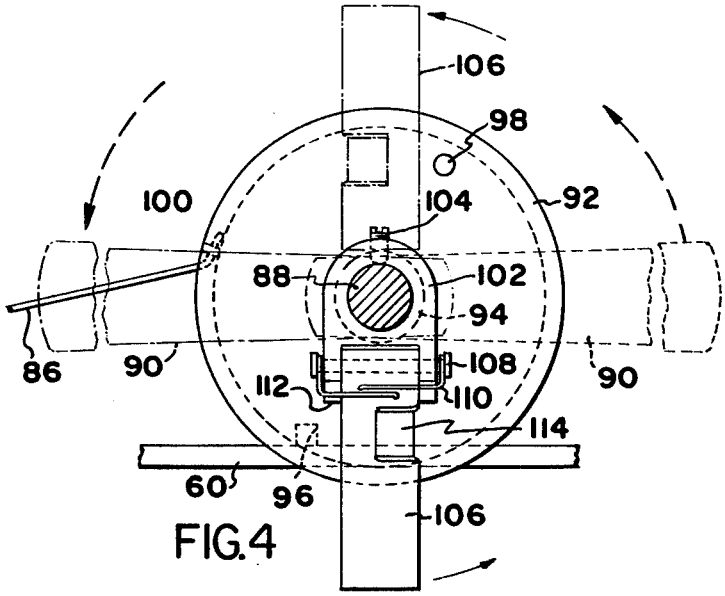
FIG. 4 is a detailed cross sectional view taken on the line 4—4 of FIG. 1.
Figure 5:
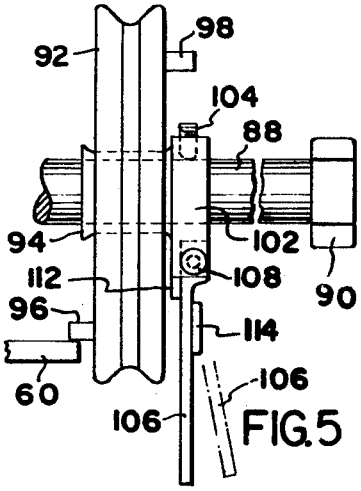
FIG. 5 is a detailed cross sectional view taken on the line 5—5 of FIG. 1.
Figure 6:
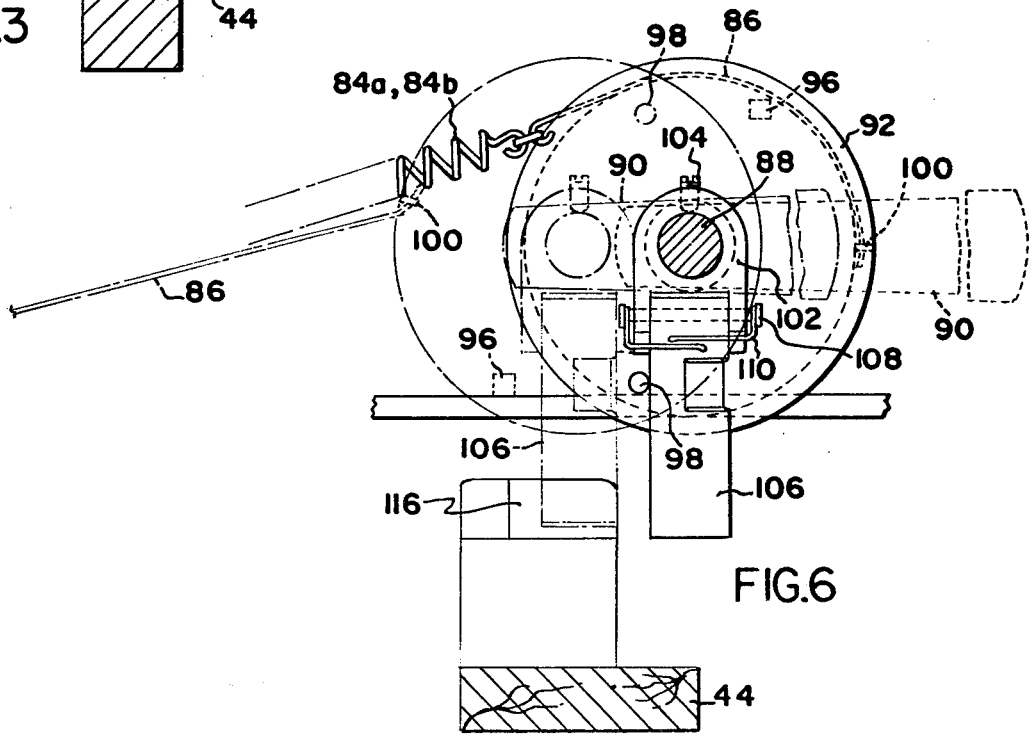
FIG. 6 is a detailed cross sectional view taken on the line 4—4 of FIG. 1, showing the parts in a different position.

Referring now particularly to FIGS. 4–6, a reel 92 is mounted for free rotation upon shaft 88 as by a bushing 94 which accommodates rotation of reel 92 relative to shaft 88 while maintaining reel 92 at a fixed location axially of shaft 88. As best seen in FIG. 5, a stop pin 96 projects axially from one side of the reel and a drive pin 98 is fixedly mounted on and projects axially from the opposite side of reel 92. Line 86, which is connected to springs **84*a*, 84*b*, is connected at its other end to a line connector 100 fixedly mounted on the periphery of reel 92. Because springs 84*a* and 84*b* apply at least a minimum amount of tension to line 86 at all times, line 86 rotatably biases reel 92 to the position shown in FIG. 4, this position being established by the engagement of stop pin 96 and the central fore and aft frame member 60 on carriage 24**.

A reel drive hub 102 is rotatably locked to shaft 88, as by set screw 104, closely adjacent that side of reel 92 from which drive pin 98 projects. A reel drive arm 106 is hingedly mounted upon hub 102 as by hinge pin 108 and a torsion spring 110 resiliently biases arm 106 in a clockwise direction to the full line position shown in FIG. 5, this position being established by the engagement between arm 106 and a stop surface 112 on hub 102.

At a radial distance from the shaft axis corresponding to that of stop pin 98 from the shaft axis, an inclined ramp surface 114 is formed on arm 106. Referring to FIG. 4, the ramp surface 114 is operable, upon counterclockwise rotation of arm 106 as viewed in FIG. 4 to engage stop pin 98 to cam arm 106 outwardly about its hinge pin 108 so that the arm can slide freely over the outer end of pin 98 as arm 106 moves past pin 98 in a counterclockwise direction. Once arm 106 is in the broken line position of FIG. 4, torsion spring 110 swings arm 106 back toward the adjacent base of reel 98. Upon clockwise rotation of arm 106 from the broken line position of FIG. 4, the arm engages drive pin 98 to transmit clockwise rotation of arm 106 to reel 92.

In FIG. 4, the phantom showing of operating arm 90 at the 3 o'clock position and the full line showing of drive arm 106 represents the rotative position of shaft 88 in which foot rest linkage FL retains foot rest F at its retracted position. The phantom showing of arm 90 at the 9 o'clock position and the dotted line showing of drive arm 106 in FIG. 4 represents the rotative position of shaft 88 when the foot rest F is at its fully extended position. Thus, assuming an occupant is seated in the chair with the foot rest F in its retracted position, as shown in FIG. 2, for example, reel 92 would be held by tension springs **84*a*, 84*b* and line 86 in the full line position shown in FIG. 4. If the occupant were to extend the foot rest by swinging operating arm 90 180° from its 3 o'clock position of FIG. 4 to 9 o'clock position of FIG. 4, reel 92 would remain stationary and drive arm 106 would be cammed over the end of drive pin 98 by ramp 114, as described above, to arrive at the rotated position indicated in broken line in FIG. 4. As explained above, torsion spring 110 would bias arm 106 toward reel 92 so that arm 106 when in the broken line position of FIG. 4 would be in axial alignment with the projected drive pin 98. Should the occupant of the chair now manipulate arm 90 to retract the foot rest and restore arm 90 to the 3 o'clock position shown in FIG. 4, during this movement drive arm 106 would be driven in a clockwise direction as viewed in FIG. 4 into engagement with drive pin 98 and in returning arm 106 to the full line position shown in FIG. 4, drive pin 98 would be driven in front of arm 106 through approximately 180° to the position shown in FIG. 6. The clockwise rotation thus imparted to reel 92 reels line 86 on the periphery of the reel as shown in FIG. 6, thus substantially increasing the tension exerted by springs 84*a* and 84*b***. This increased tension will normally not overcome the gravitational bias holding the carriage at its forward end limit as long as the chair is occupied, but will promptly and firmly retract the carriage to its rearward end limit as soon as the occupant arises from the chair.

If it is assumed that the above described manipulation of operating arm 90 occurred while the carriage 24 was at its forward end limit of movement, it is believed apparent that a substantial increase in tension is thus applied to the spring system so that when the occupant arises from the chair a substantial biasing force is present to restore the carriage to its rearward against-the-wall position upon the return of the footrest to its retracted position. Return of the footrest to its retracted position is a practical necessity for the occupant to prepare to arise from the chair. The increased tension is automatically released from the spring system when the chair arrives at its rearward against-the-wall position by a stationary cam member 116 (FIGS. 6 and 7) which is mounted on central cross frame member 44 of the chair base. Cam surface 116 is inclined with respect to the fore and aft direction of the chair and as the carriage moves to its rearward end limit of movement, drive arm 106 moves into engagement with this inclined surface which forces the drive arm outwardly away from the adjacent surface of reel 92 by swinging drive arm 106 outwardly about its hinge pin. As soon as arm 106 is swung outwardly beyond the end of drive pin 98, reel 92 is free to rotate in a counterclockwise direction as viewed in FIG. 6 and the tension in springs **84*a* and 84*b*** drives the reel in counterclockwise rotation to return the reel to the FIG. 4 position established by the engagement of stop pin 96 with carriage frame member 60. The counterclockwise rotation of reel 92 thus releases the increased tension from the spring system when the chair is at its rearward end limit of movement.

Optimum operation of the spring return system assumes that the occupant will not manually extend and retract the foot rest prior to reclining in the against-the-wall position. Should the occupant, with the chair in the against-the-wall position extend the foot rest prior to initiating a reclining movement which released latch 76,80, the extension of the foot rest merely cocks the spring system and does not increase the spring tension to oppose forward movement of the carriage. It is only when the foot rest is retracted that the spring tension is increased. Normally, retraction of the foot rest is required in order to enable the occupant to conveniently arise from the chair.

While the actuation of the spring tension increasing mechanism has been explained above in connection with a manually actuated foot rest, it is pointed out that in a broader sense the spring tension increasing mechanism is operated by a member which moves in response or coordination with a reclining function of the chair. Thus, any portion of a reclining chair linkage having a practical range of movement relative to the chair base between normal upright and reclined positions could provide the necessary motion for extending the spring in the manner described above. As employed in the following claims, the term "normal position" refers to the normal upright position of the chair seat and back and to the retracted position of the foot rest, while the term "reclined position" refers to the reclined position of the seat and back and to the extended position of the foot rest.

While one embodiment of the invention has been described in detail, it will be apparent, as explained above, that the disclosed embodiment may be modified. Therefore, the foregoing description is to be considered exemplary rather than limiting, and the true scope of the invention is that defined in the following claims.

I claim:

1. In an against-the-wall type reclining chair having a carriage mounted upon a base for movement relative to the base between a rearward against-the-wall position and a forward away-from-the-wall position, chair seat, back and footrest elements, reclining linkage means supporting said elements upon said carriage for movement between respective normal and reclined positions, an actuating member on said carriage movable back and forth between a first and second position for moving at least one of said seat, back and footrest elements between its normal and reclined positions, respectively, and return spring means biasing said carriage to its rearward position, said carriage being gravitationally maintained at said forward position against the action of said return spring means when said chair is occupied and said return spring means being operable to return said carriage to said rearward position when said chair is unoccupied; the improvement wherein said return spring means comprises tension spring means coupled at one end to said base, coupling means mounted on said member coupling the other end of said tension spring to said carriage via said member, one way releasable drive means in said coupling means operable when engaged to cause movement of said member from said second position to said first position to extend said spring means by a fixed amount to thereby increase the spring bias applied to said carriage, and drive release means operable when said carriage is at said rearward position to disengage said drive means to permit said tension spring means to contract by said fixed amount.

2. The invention defined in claim 1 wherein said member is a shaft rotatable between said first and said second positions, said coupling means includes a reel freely rotatable on said shaft and a line coupled between said reel and said spring means, and said drive means includes a drive member rotatable with said shaft and releasably engageable in driving relationship with said reel.

3. The invention defined in claim 2 wherein said said one of said elements is said footrest and said shaft is manually rotatable to extend or retract said footrest relative to said seat.

4. The invention defined in claim 2 wherein said drive means comprises a pin projecting axially from said one side of reel at a location offset from the reel axis, said drive member being shiftable toward and away from said one side of said reel between an engaged position adjacent said reel wherein rotation of said shaft drives said member into engagement with said pin and a disengaged position remote from said reel wherein said drive member passes clear of said pin.

5. The invention defined in claim 4 further comprising spring means biasing said drive member to said engaged position and cam means on said drive member operable upon rotation of said drive member in one direction to enable said drive member to be rotated past said pin.

6. The invention defined in claim 2 wherein said coupling means comprises a flexible line coupled at one end to said tension spring means and coupled at its other end to a fixed point on the periphery of said reel.

7. The invention defined in claim 1 further comprising releasable latch means for releasably retaining said carriage in its against-the-wall position.

8. The invention defined in claim 4 wherein said drive release means comprises a cam member mounted on said base for maintaining said drive member in said disengaged position when said carriage is at said rearward position.

9. The invention defined in claim 8 wherein said cam member comprises a wedge shaped member fixed to said base to project between said reel and the engaged drive member as said carriage moves rearwardly toward said rearward position to progressively force said drive member from its engaged position toward said disengaged position as said carriage approaches its rearward position.

* * * * *